US010561923B1

(12) United States Patent
Harvey

(10) Patent No.: US 10,561,923 B1
(45) Date of Patent: Feb. 18, 2020

(54) COLLAPSIBLE FOAM ROLLER

(71) Applicant: Dishawn Harvey, Knightdale, NC (US)

(72) Inventor: Dishawn Harvey, Knightdale, NC (US)

( * ) Notice: Subject to any disclaimer, the term of this patent is extended or adjusted under 35 U.S.C. 154(b) by 57 days.

(21) Appl. No.: 16/002,794

(22) Filed: Jun. 7, 2018

Related U.S. Application Data

(60) Provisional application No. 62/518,027, filed on Jun. 12, 2017.

(51) Int. Cl.
*A63B 71/00* (2006.01)
*A63B 21/00* (2006.01)
*A63B 22/20* (2006.01)

(52) U.S. Cl.
CPC ..... *A63B 71/0036* (2013.01); *A63B 21/4035* (2015.10); *A63B 22/20* (2013.01); *A63B 2210/50* (2013.01)

(58) Field of Classification Search
None
See application file for complete search history.

(56) References Cited

U.S. PATENT DOCUMENTS

| | | | | |
|---|---|---|---|---|
| 10,071,014 | B2 * | 9/2018 | Yeh | A61H 15/00 |
| 10,137,055 | B2 * | 11/2018 | Lawrie | A61H 15/0092 |
| 2005/0215928 | A1 * | 9/2005 | Banks | A61H 15/0092 601/112 |
| 2018/0339216 | A1 * | 11/2018 | Gencarelli | A61H 7/004 |
| 2019/0135490 | A1 * | 5/2019 | Munoz | A45C 3/001 |

* cited by examiner

*Primary Examiner* — Nyca T Nguyen
(74) *Attorney, Agent, or Firm* — Quickpatents, LLC; Kevin Prince

(57) ABSTRACT

A collapsible foam roller device includes at least one telescoping roller section that has at least two rigid telescoping rings. Each ring has an inside surface, an outside surface, a flared leading edge and a flared trailing edge. The trailer edge of an outermost ring is adapted to grasp and hold the leading edge of an adjacent ring. A foam cover is applied to the outside surface of each ring. In one embodiment, the foam roller device comprises two of the roller sections, each roller section sharing a common innermost ring. In an alternate embodiment, the foam roller device comprises four of the roller sections. A first and second roller sections share a common innermost ring; the second and a third roller section share a common outermost ring; and the third and a fourth roller sections share a common innermost ring. Preferably the foam roller device further includes two endcaps.

13 Claims, 5 Drawing Sheets

COLLAPSIBLE FOAM ROLLER

CROSS-REFERENCE TO RELATED APPLICATIONS

This application claims the benefit of U.S. Provisional Patent Application 62/518,027, filed on Jun. 12, 2017, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a collapsible foam roller device.

DISCUSSION OF RELATED ART

Currently there are a number of solutions for transporting a foam roller, commonly used by exercisers. Some of these solutions attempt to flatten the foam roller, but these solutions fail to meet the needs of the industry because there is not much space saved, nor is it convenient to use. Other solutions attempt to simply carry the product, but these solutions are similarly unable to meet the needs of the industry because no space is saved, the product is still bulky and difficult to transport. Still other solutions seek to cut the product size altogether, but these solutions also fail to meet industry needs because the original size is now lost and another product must be purchased for full capabilities (with a full-size roller) when desired.

It would be desirable to have a foam roller that collapses to save space when going from one place to another. Furthermore, it would also be desirable to have a foam roller that can be used in two different ways, while collapsed or while full size. Still further, it would be desirable to have a foam roller that naturally forms to body parts. Therefore, there currently exists a need in the industry for a more versatile and advanced foam rolling system that can easily be stored without being in the way if stored away. The present invention accomplishes these objectives.

SUMMARY OF THE INVENTION

The present device is a collapsible foam roller device for a user/exerciser to use on a support surface, such as a floor. At least one telescoping roller section includes at least two rigid telescoping rings. Each ring has an inside surface, an outside surface, a flared leading edge and a flared trailing edge. The trailer edge of an outmost ring is adapted to grasp and hold the leading edge of an adjacent ring. A foam cover is applied to the outside surface of each ring, such as with an adhesive or the like.

In one embodiment, wherein only two of the rings are present in each ring section, the outermost ring is adapted to grasp and hold an innermost ring. In alternate embodiments with more than two of the rings, the outermost ring is adapted to grasp and hold an innermost ring. There may be multiple innermost rings that terminate finally with the innermost ring. The number of innermost rings may be adapted along with the width of the rings to obtain a roller section having nearly any desired length.

In one embodiment, the foam roller device comprises two of the roller sections, each roller section sharing a common innermost ring. In such an embodiment, in the collapsed position the two outermost rings abut to cover the other rings. As such, the foam roller device results in a central recessed area or trough conforming to a user's body while in use.

In an alternate embodiment, the foam roller device comprises four of the roller sections. A first and second roller sections share a common innermost ring; the second and a third roller section share a common outermost ring; and the third and a fourth roller sections share a common innermost ring. As such, when in the collapsed position, the three outermost rings each abut at least one of the other outmost rings to cover the remaining rings. As such, the foam roller device results in a central raised area for pressing against a central portion of a user's body while in use, such as the user's spine. Alternately, the user's legs may each be confined to a recessed area of the foam roller device proximate the two innermost rings.

Preferably the foam roller device further includes two endcaps fixed within the leading edges of the two outermost rings at ends of the foam roller device. Such endcaps preferably include an outwardly-projecting handle such that a user may pull the two handles apart to move the foam roller device from its collapsed position to its extended position. The endcaps are preferably fixed in place on the outermost rings mechanically such that they are not removable.

The present invention is a foam roller that collapses to save space during storage and transportation. Furthermore, the present foam roller can be used in two different ways, while collapsed or while fully extended. Still further, the foam roller naturally conforms to body parts, making a more versatile and advanced foam rolling system that can easily be stored without being in the way. Other features and advantages of the present invention will become apparent from the following more detailed description, taken in conjunction with the accompanying drawings, which illustrate, by way of example, the principles of the invention.

DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 4A:
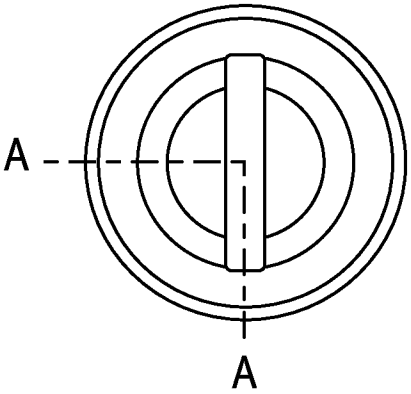
FIG. 4A is a side elevational view thereof.
Figure 4B:
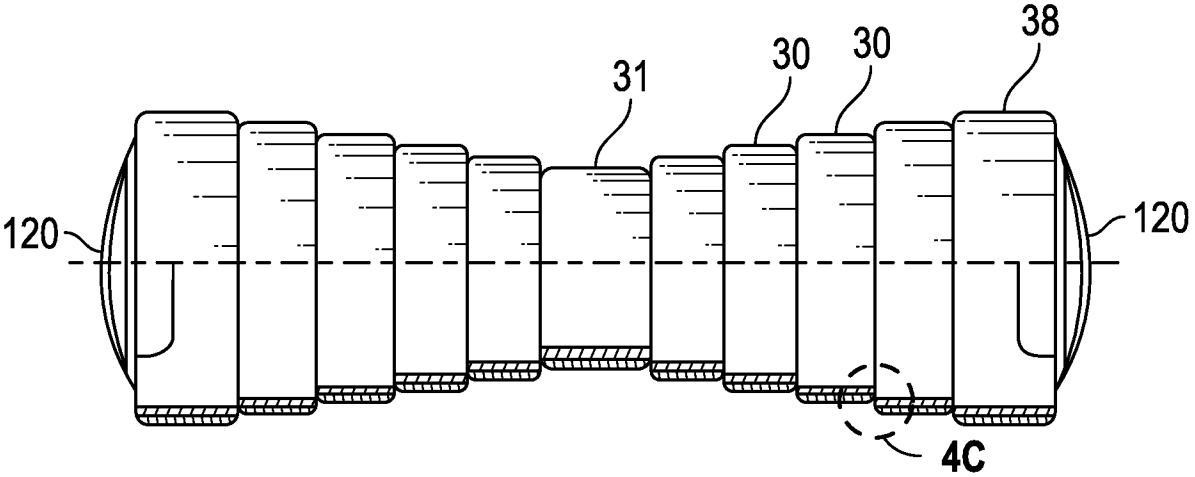
FIG. 4B is an elevational view, partially shown in cross-section along line A-A of FIG. 4A.
Figure 4C:
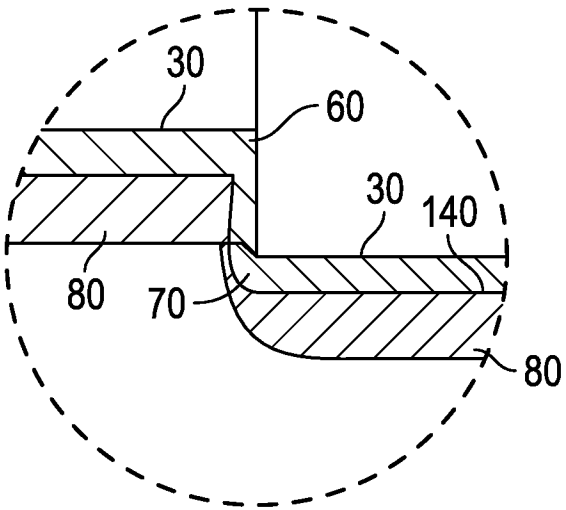
FIG. 4C is an enlarged elevational view, taken from line 4C-4C of FIG. 4B.
Figure 5:
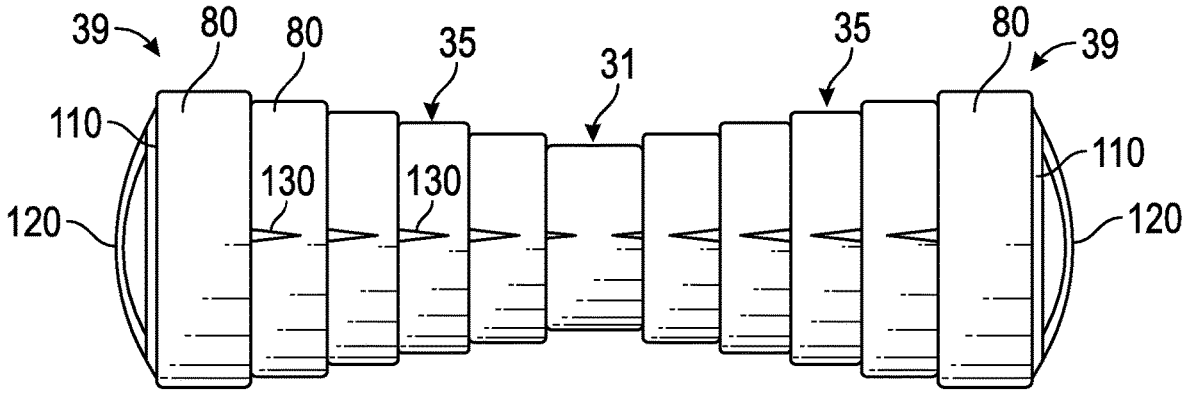
FIG. 5 is a front elevational view of a third embodiment of the invention, similar to the embodiment shown in FIG. 1A but shown with strain cuts in some of the rings of the invention.

FIGS. 1A-3 illustrate a collapsible foam roller device 10 for a user/exerciser to use on a support surface, such as a floor (not shown). At least one telescoping roller section 20 includes at least two rigid telescoping rings 30. Each ring 30 has an inside surface 40, an outside surface 50, a flared leading edge 60 and a flared trailing edge 70. As used herein, the term "flared" may mean either gradually becoming wider (or narrower) at one end, or suddenly becoming wider or narrower such with a projecting lip at substantially a 90-degree angle with the ring 30 (as shown). The trailer edge 70 of an outmost ring 39 is adapted to grasp and hold the leading edge 60 of an adjacent ring 30 (FIGS. 4A-4C). A foam cover 80 is applied to the outside surface 50 of each ring 30, such as with an adhesive 140 or the like. Preferably each ring 30 is made from a strong metal or plastic material.

In one embodiment, wherein only two of the rings 30 are present in each ring section 20, the outermost ring 39 is adapted to grasp and hold an innermost ring 30. In alternate embodiments with more than two of the rings 30, the outermost ring 39 is adapted to grasp and hold an innermost ring 35. There may be multiple innermost rings 35 that terminate finally with the innermost ring 31. The number of innermost rings 35 may be adapted along with the width of the rings 30 to obtain a roller section 20 having nearly any desired length.

Figure 1A:
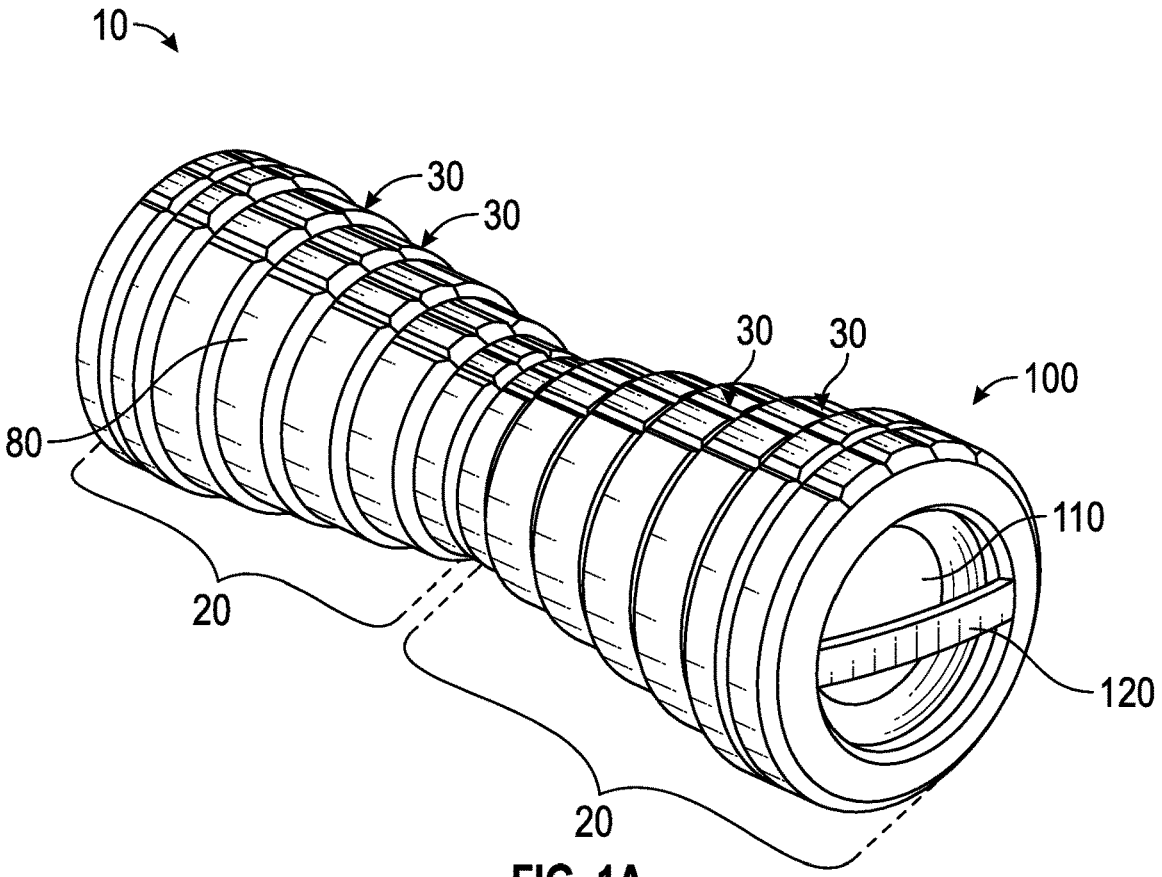
FIG. 1A is a perspective view of a first embodiment of the invention, illustrated in an expanded position.
Figure 1B:
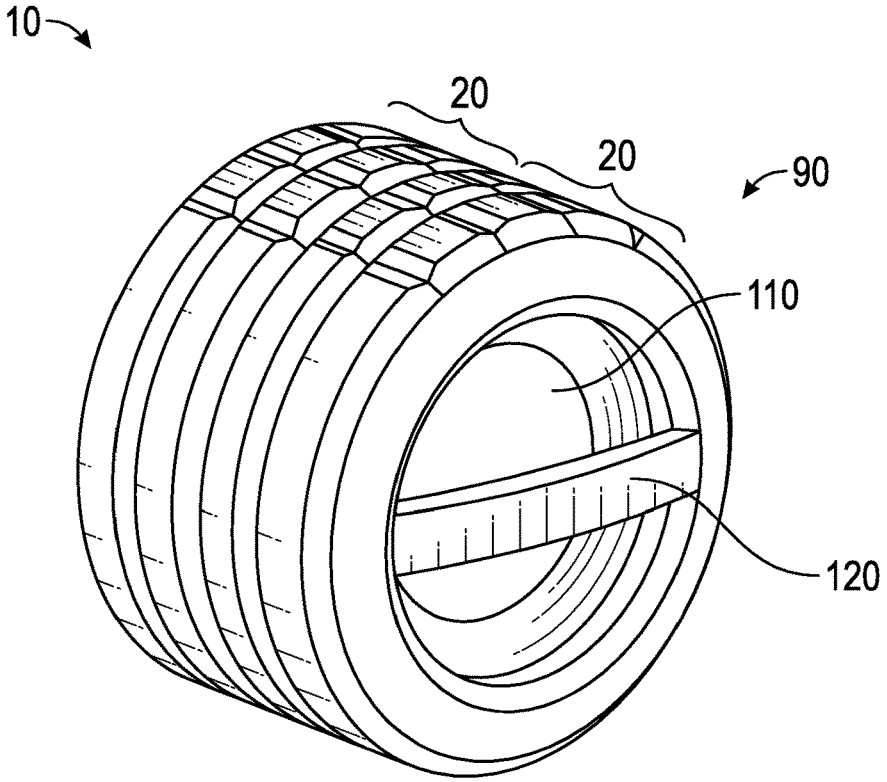
FIG. 1B is a perspective view of the embodiment of FIG. 1A, shown in a collapsed position.
Figure 6:
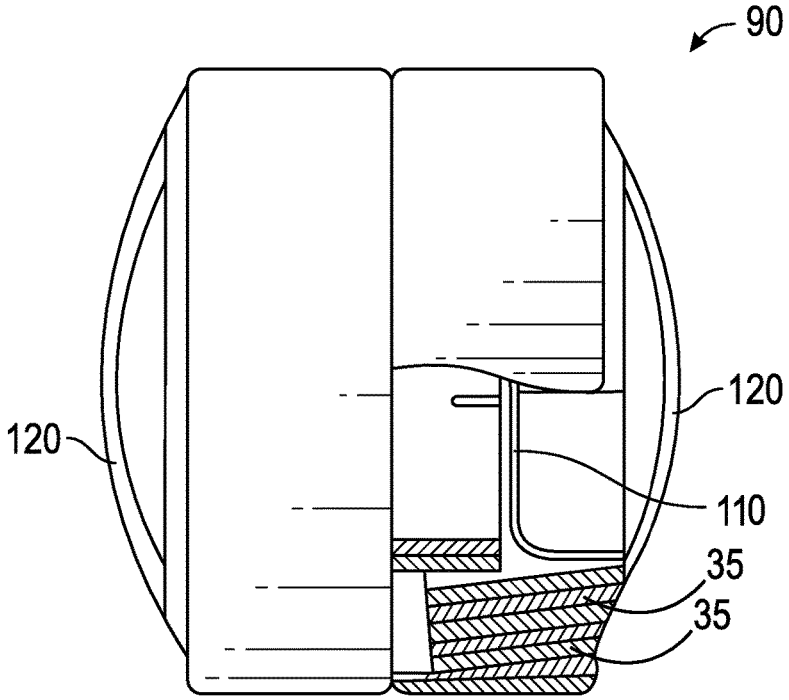
FIG. 6 is an enlarged side elevational view of the invention, partially shown in cross-section along line A-A of FIG. 4A, and illustrating the collapsed position of the invention.

In one embodiment, the foam roller device 10 comprises two of the roller sections 20, each roller section 20 sharing a common innermost ring 31 (FIGS. 1A, 1B, 3, 4B, 5 and 6). In such an embodiment, in the collapsed position 90 the two outermost rings 39 abut to cover the other rings 30 (FIGS. 1B and 6). As such, the foam roller device 10 results in a central recessed area or trough conforming to a user's body while in use.

Figure 2A:
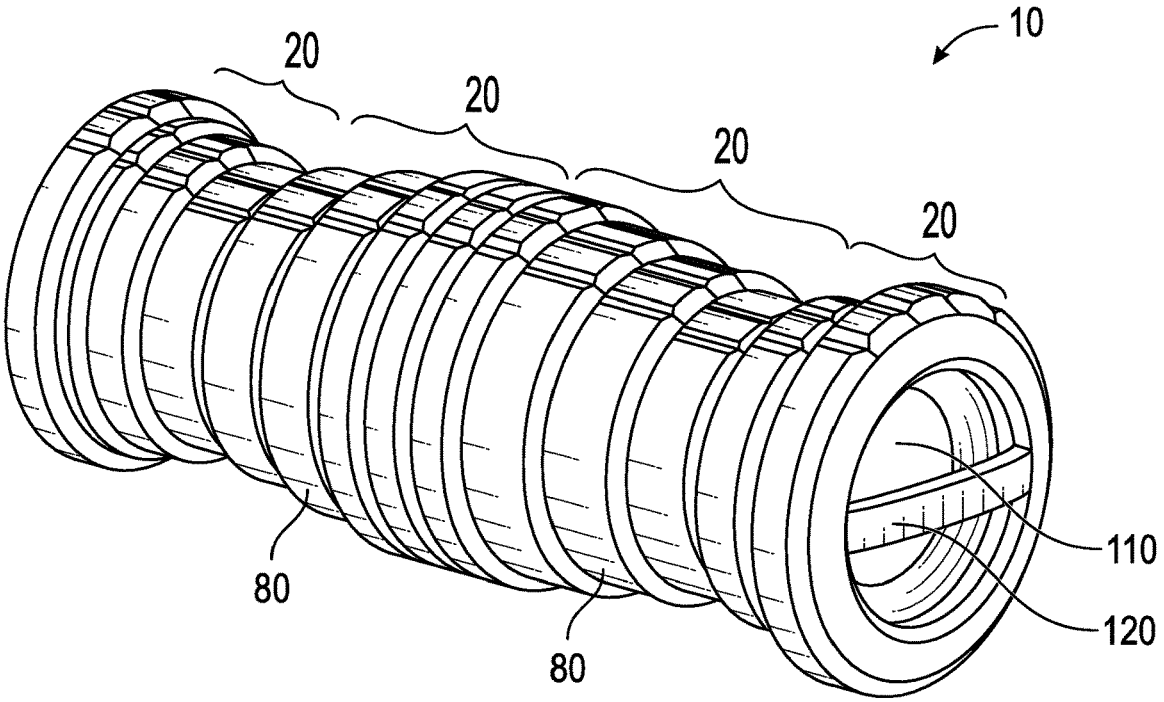
FIG. 2A is a perspective view of a second embodiment of the invention, illustrated in the expanded position.
Figure 2B:
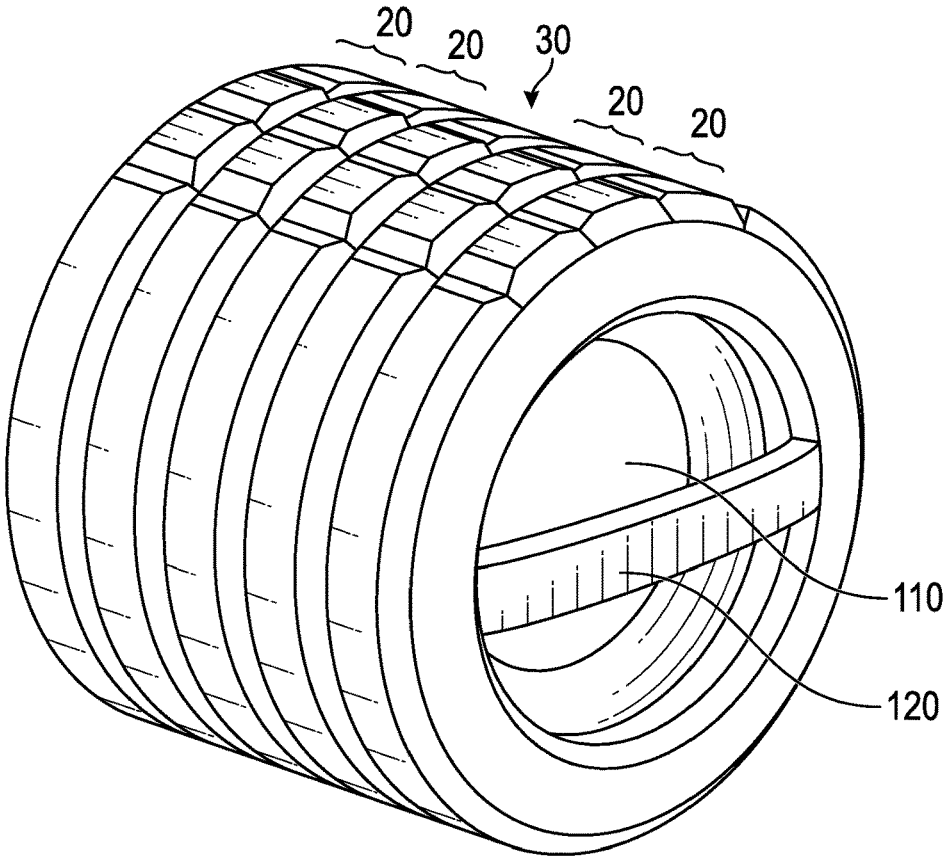
FIG. 2B is a perspective view of the embodiment of FIG. 2A, shown in the collapsed position.
Figure 3:
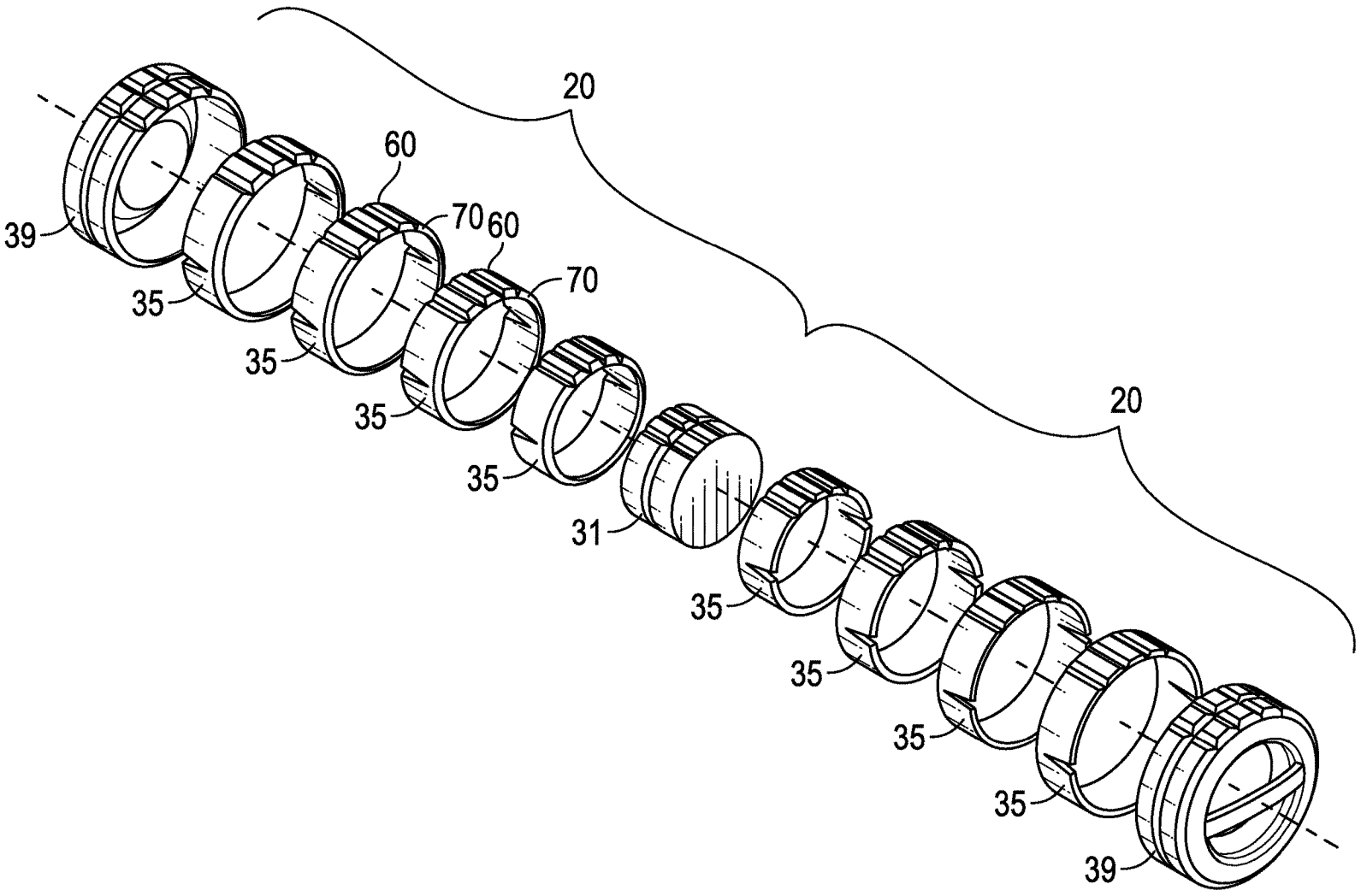
FIG. 3 is an exploded perspective view of the embodiment of FIG. 1A.

In an alternate embodiment, illustrated in FIGS. 2A and 2B, the foam roller device 10 comprises four of the roller sections 20. A first and second roller sections share a common innermost ring 31; the second and a third roller section 20 share a common outermost ring 39, and the third and a fourth roller sections 20 share a common innermost ring 31. As such, when in the collapsed position 90, the three outermost rings 39 each abut at least one of the other outmost rings 39 to cover the remaining rings 35,31. As such, the foam roller device 10 results in a central raised area for pressing against a central portion of a user's body while in use, such as the user's spine. Alternately, the user's legs may each be confined to a recessed area of the foam roller device 10 proximate the two innermost rings 31.

Preferably the foam roller device 10 further includes two endcaps 110 fixed within the leading edges 60 of the two outermost rings 39 at ends of the foam roller device 10 (FIGS. 4B-6). Such endcaps 110 preferably include an outwardly-projecting handle 120 such that a user may pull the two handles 120 apart to move the foam roller device 10 from its collapsed position 90 to its extended position 100. The endcaps 110 are preferably fixed in place on the outermost rings 39 mechanically such that they are not removable.

In some embodiments, some of the rings 30 may include strain cuts 130 for relieving stress experienced by the collapsible foam roller device 10 upon introduction thereto of a weighted load, such as an exerciser.

While a particular form of the invention has been illustrated and described, it will be apparent that various modifications can be made without departing from the spirit and scope of the invention. For example, additional roller sections 20 may be added to form a roller with six, eight, or more roller sections, perhaps having rings 30 of smaller widths. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A collapsible foam roller device, comprising:

at least one telescoping roller section comprising at least two rigid telescoping rings, each ring having an inside surface, an outside surface, a flared leading edge and a flared trailing edge, the trailing edge of an outermost ring adapted to grasp and hold the leading edge of an adjacent innermost ring;

a foam covering applied to the outside surface of each ring;

whereby each roller section can be moved from a collapsed position wherein each ring is substantially cover each adjacent innermost ring, to an expanded position wherein each ring is extended axially away from each adjacent innermost ring so that the trailing edge of each ring grasps and holds the leading edge of the next adjacent innermost ring.

2. The collapsible foam roller device of claim 1 having two of the roller sections, each roller section sharing a common innermost ring;

whereby in the collapsed position the two outermost rings abut to cover the remaining rings.

3. The collapsible foam roller device of claim 2 wherein the two outermost rings each include an endcap fixed within their leading edges.

4. The collapsible foam roller device of claim 3 wherein each endcap includes an outwardly-projecting handle.

5. The collapsible foam roller device of claim 2 having an outermost ring, an innermost ring, and four rings therebetween.

6. The collapsible foam roller device of claim 5 wherein each ring is substantially the same width, except for the innermost ring which is substantially twice the width of the other rings.

7. The collapsible foam roller device of claim 1 having four of the roller sections, a first and a second roller sections sharing a common innermost ring; the second and a third roller section sharing a common outermost ring, and the third and a fourth roller sections sharing a common innermost ring;

whereby in the collapsed position the four outermost rings each abut at least one of the other outmost rings to cover the remaining rings.

8. The collapsible foam roller device of claim 7 wherein the two outermost rings each include an endcap fixed within their leading edges.

9. The collapsible foam roller device of claim 7 wherein each endcap includes an outwardly-projecting handle.

10. The collapsible foam roller device of claim 7 having three outermost rings, two innermost rings, and two rings between each outermost ring and one of the innermost rings.

11. The collapsible foam roller device of claim 10 wherein each ring is substantially the same width, except for the innermost rings and a central outermost ring, which are substantially twice the width of the other rings.

12. The collapsible foam roller device of claim 1 wherein at least one innermost ring includes a plurality of strain cuts through the leading edge thereof to relieve strain experienced by the collapsible foam roller upon introduction thereto of a weighted load.

13. The collapsible foam roller device of claim 1 wherein the foam covering is applied to the outside surface of each ring with an adhesive.

* * * * *